US007592977B2

(12) United States Patent
Park

(10) Patent No.: US 7,592,977 B2
(45) Date of Patent: Sep. 22, 2009

(54) PLASMA DISPLAY PANEL AND METHOD FOR PROCESSING PICTURES THEREOF

(75) Inventor: Seung-Ho Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 678 days.

(21) Appl. No.: 11/219,051

(22) Filed: Sep. 1, 2005

(65) Prior Publication Data

US 2006/0152444 A1 Jul. 13, 2006

(30) Foreign Application Priority Data

Jan. 12, 2005 (KR) ..... 10-2005-0002818

(51) Int. Cl.
*G09G 3/28* (2006.01)

(52) U.S. Cl. ..... 345/63; 345/60

(58) Field of Classification Search ..... 345/60–69, 345/698–699; 315/169.3–169.4
See application file for complete search history.

(56) References Cited

U.S. PATENT DOCUMENTS

| | | | | |
|---|---|---|---|---|
| 7,154,516 | B2 | 12/2006 | Kawahara et al. | |
| 2001/0028347 | A1* | 10/2001 | Kawahara et al. | 345/204 |
| 2001/0033260 | A1* | 10/2001 | Nishitani et al. | 345/87 |
| 2002/0084954 | A1* | 7/2002 | Nagai | 345/60 |
| 2002/0135595 | A1* | 9/2002 | Morita et al. | 345/589 |
| 2005/0237277 | A1 | 10/2005 | Kawahara | |

FOREIGN PATENT DOCUMENTS

| | | | |
|---|---|---|---|
| CN | 1516093 | A | 7/2004 |
| EP | 0 893 916 | A2 | 1/1999 |
| EP | 1 376 521 | A1 | 1/2004 |
| JP | 11-259043 | | 9/1999 |
| JP | 2001-83925 | | 3/2001 |
| JP | 2003-43979 | | 2/2003 |

(Continued)

OTHER PUBLICATIONS

Patent Abstracts of Japan for Publication No. 2003177696; Publication Date Jun. 27, 2003, in the name of Tomoko Morita.

(Continued)

*Primary Examiner*—Chanh Nguyen
*Assistant Examiner*—Long Pham
(74) *Attorney, Agent, or Firm*—Christie Parker & Hale LLP

(57) ABSTRACT

A plasma display device and an image processing method thereof for reducing false contour and avoiding a low discharge at grayscales include detecting a moving image block and a still image block from input video signals. The output of grayscales of the detected still image block is determined such that the number of consecutive non-lighting subfields is less than or equal to L among fields driven previously to a last turn-on subfield of the corresponding output grayscale. The output grayscale of the detected moving image block is determined such that a number of consecutive non-lighting subfields is less than or equal to M and the total of non-lighting subfields is less than or equal to N among fields driven previously to a last turn-on subfield of a corresponding output grayscale.

16 Claims, 9 Drawing Sheets

FOREIGN PATENT DOCUMENTS

| | | |
|---|---|---|
| JP | 2003-177696 | 6/2003 |
| JP | 2003-223132 | 8/2003 |
| KR | 2002-0061910 | 7/2002 |
| KR | 10-2004-0027911 | 4/2004 |
| WO | WO00/62275 | 10/2000 |
| WO | WO 03/091975 A1 | 11/2003 |

OTHER PUBLICATIONS

Patent Abstracts of Japan for Publication No. 2003043979; Publication Date Jul. 31, 2001, in the name of Isao Kawahara.

European Search Report for Application No. 05108434.1, Dated Dec. 5, 2005, in the name of Samsung SDI Co., Ltd.

Patent Abstracts of Japan, Publication No. 11-259043; Date of Publication: Sep. 24, 1999; in the name of Kazuo Ohira et al.

Patent Abstracts of Japan, Publication No. 2001-083925; Date of Publication: Mar. 30, 2001; in the name of Tadao Kyomoto et al.

Patent Abstracts of Japan, Publication No. 2003-223132; Date of Publication: Aug. 8, 2003; in the name of Isao Kawahara.

Korean Patent Abstracts, Publication No. 1020020061910 A; Date of Publication: Jul. 25, 2002; in the name of Gi Sang Hong et al.

* cited by examiner

PRIOR ART

FIG.4A

| Subfield | sf1 | sf2 | sf3 | sf4 | sf5 | sf6 | sf7 | sf8 | sf9 | sf10 | Input grayscale selection | Output grayscale candidate |
|---|---|---|---|---|---|---|---|---|---|---|---|---|
| Weight / Input grayscale | 1 | 2 | 4 | 8 | 16 | 32 | 42 | 44 | 52 | 54 | | |
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 1 | 1 |
| 2 | 0 | 1 | 0 | 0 | 0 | 0 | 0 | 0 | 0 | 0 | × | 1,3 |
| 3 | 1 | 1 | 0 | 0 | 0 | 0 | 0 | 0 | 0 | 0 | 3 | 3 |
| 4 | 0 | 0 | 1 | 0 | 0 | 0 | 0 | 0 | 0 | 0 | × | 3,5 |
| 5 | 1 | 0 | 1 | 0 | 0 | 0 | 0 | 0 | 0 | 0 | 5 | 5 |
| 6 | 0 | 1 | 1 | 0 | 0 | 0 | 0 | 0 | 0 | 0 | × | 5,7 |
| 7 | 1 | 1 | 1 | 0 | 0 | 0 | 0 | 0 | 0 | 0 | 7 | 7 |
| 8 | 0 | 0 | 0 | 1 | 0 | 0 | 0 | 0 | 0 | 0 | × | 7,9 |
| 9 | 1 | 0 | 0 | 1 | 0 | 0 | 0 | 0 | 0 | 0 | 9 | 9 |
| 10 | 0 | 1 | 0 | 1 | 0 | 0 | 0 | 0 | 0 | 0 | × | 9,11 |
| 11 | 1 | 1 | 0 | 1 | 0 | 0 | 0 | 0 | 0 | 0 | 11 | 11 |
| 12 | 0 | 0 | 1 | 1 | 0 | 0 | 0 | 0 | 0 | 0 | × | 11,13 |
| 13 | 1 | 0 | 1 | 1 | 0 | 0 | 0 | 0 | 0 | 0 | 13 | 13 |
| 14 | 0 | 1 | 1 | 1 | 0 | 0 | 0 | 0 | 0 | 0 | × | 13,15 |
| 15 | 1 | 1 | 1 | 1 | 0 | 0 | 0 | 0 | 0 | 0 | 15 | 15 |
| 16 | 0 | 0 | 0 | 0 | 1 | 0 | 0 | 0 | 0 | 0 | × | 15,19 |
| 17 | 1 | 0 | 0 | 0 | 1 | 0 | 0 | 0 | 0 | 0 | × | 15,19 |
| 18 | 0 | 1 | 0 | 0 | 1 | 0 | 0 | 0 | 0 | 0 | × | 15,19 |
| 19 | 1 | 1 | 0 | 0 | 1 | 0 | 0 | 0 | 0 | 0 | 19 | 19 |
| 20 | 0 | 0 | 1 | 0 | 1 | 0 | 0 | 0 | 0 | 0 | × | 19,21 |
| 21 | 1 | 0 | 1 | 0 | 1 | 0 | 0 | 0 | 0 | 0 | 21 | 21 |
| 22 | 0 | 1 | 1 | 0 | 1 | 0 | 0 | 0 | 0 | 0 | × | 21,23 |
| 23 | 1 | 1 | 1 | 0 | 1 | 0 | 0 | 0 | 0 | 0 | 23 | 23 |
| 24 | 0 | 0 | 0 | 1 | 1 | 0 | 0 | 0 | 0 | 0 | × | 23,25 |
| 25 | 1 | 0 | 0 | 1 | 1 | 0 | 0 | 0 | 0 | 0 | 25 | 25 |

FIG.4B

| Subfield | sf1 | sf2 | sf3 | sf4 | sf5 | sf6 | sf7 | sf8 | sf9 | sf10 | Input grayscale selection | Output grayscale candidate |
|---|---|---|---|---|---|---|---|---|---|---|---|---|
| Weight / Input grayscale | 1 | 2 | 4 | 8 | 16 | 32 | 42 | 44 | 52 | 54 | | |
| 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 1 | 1 |
| 2 | 0 | 1 | 0 | 0 | 0 | 0 | 0 | 0 | 0 | 0 | × | 1,3 |
| 3 | 1 | 1 | 0 | 0 | 0 | 0 | 0 | 0 | 0 | 0 | 3 | 3 |
| 4 | 0 | 0 | 1 | 0 | 0 | 0 | 0 | 0 | 0 | 0 | × | 3,5 |
| 5 | 1 | 0 | 1 | 0 | 0 | 0 | 0 | 0 | 0 | 0 | 5 | 5 |
| 6 | 0 | 1 | 1 | 0 | 0 | 0 | 0 | 0 | 0 | 0 | × | 5,7 |
| 7 | 1 | 1 | 1 | 0 | 0 | 0 | 0 | 0 | 0 | 0 | 7 | 7 |
| 8 | 0 | 0 | 0 | 1 | 0 | 0 | 0 | 0 | 0 | 0 | × | 7,11 |
| 9 | 1 | 0 | 0 | 1 | 0 | 0 | 0 | 0 | 0 | 0 | × | 7,11 |
| 10 | 0 | 1 | 0 | 1 | 0 | 0 | 0 | 0 | 0 | 0 | × | 7,11 |
| 11 | 1 | 1 | 0 | 1 | 0 | 0 | 0 | 0 | 0 | 0 | 11 | 11 |
| 12 | 0 | 0 | 1 | 1 | 0 | 0 | 0 | 0 | 0 | 0 | × | 11,13 |
| 13 | 1 | 0 | 1 | 1 | 0 | 0 | 0 | 0 | 0 | 0 | 13 | 13 |
| 14 | 0 | 1 | 1 | 1 | 0 | 0 | 0 | 0 | 0 | 0 | × | 13,15 |
| 15 | 1 | 1 | 1 | 1 | 0 | 0 | 0 | 0 | 0 | 0 | 15 | 15 |
| 16 | 0 | 0 | 0 | 0 | 1 | 0 | 0 | 0 | 0 | 0 | × | 15,21 |
| 17 | 1 | 0 | 0 | 0 | 1 | 0 | 0 | 0 | 0 | 0 | × | 15,21 |
| 18 | 0 | 1 | 0 | 0 | 1 | 0 | 0 | 0 | 0 | 0 | × | 15,21 |
| 19 | 1 | 1 | 0 | 0 | 1 | 0 | 0 | 0 | 0 | 0 | × | 15,21 |
| 20 | 0 | 0 | 1 | 0 | 1 | 0 | 0 | 0 | 0 | 0 | × | 15,21 |
| 21 | 1 | 0 | 1 | 0 | 1 | 0 | 0 | 0 | 0 | 0 | 21 | 21 |
| 22 | 0 | 1 | 1 | 0 | 1 | 0 | 0 | 0 | 0 | 0 | × | 21,23 |
| 23 | 1 | 1 | 1 | 0 | 1 | 0 | 0 | 0 | 0 | 0 | 23 | 23 |
| 24 | 0 | 0 | 0 | 1 | 1 | 0 | 0 | 0 | 0 | 0 | × | 23,27 |
| 25 | 1 | 0 | 0 | 1 | 1 | 0 | 0 | 0 | 0 | 0 | × | 23,27 |
| 26 | 0 | 1 | 0 | 1 | 1 | 0 | 0 | 0 | 0 | 0 | × | 23,27 |
| 27 | 1 | 1 | 0 | 1 | 1 | 0 | 0 | 0 | 0 | 0 | 27 | |

FIG.5A

| | |
|---|---|
| 1 | 4 |
| 3 | 2 |

FIG.5B

| | | | | | | | |
|---|---|---|---|---|---|---|---|
| 11 | 43 | 16 | 48 | 3 | 35 | 7 | 39 |
| 59 | 27 | 64 | 32 | 51 | 19 | 55 | 23 |
| 5 | 37 | 6 | 38 | 10 | 42 | 12 | 44 |
| 53 | 21 | 54 | 22 | 58 | 26 | 60 | 28 |
| 15 | 47 | 2 | 34 | 14 | 46 | 4 | 36 |
| 63 | 31 | 50 | 18 | 62 | 30 | 52 | 20 |
| 1 | 33 | 9 | 41 | 8 | 40 | 13 | 45 |
| 49 | 17 | 57 | 25 | 56 | 24 | 61 | 29 |

FIG.7A

| | 1 sub frame(group of subfields) | | | | | | | | 2 sub frame(group of subfields) | | | | | | | | |
|---|---|---|---|---|---|---|---|---|---|---|---|---|---|---|---|---|---|
| Subfield | sf1 | sf2 | sf3 | sf4 | sf5 | sf6 | sf7 | sf8 | sf1' | sf2' | sf3' | sf4' | sf5' | sf6' | Difference of weight sum | Input grayscale selection | Output grayscale candidate |
| Weight / Input grayscale | 1 | 2 | 4 | 8 | 16 | 32 | 68 | 116 | 4 | 12 | 24 | 40 | 68 | 116 | | | |
| 11 | 1 | 1 | 1 | 0 | 0 | 0 | 0 | 0 | 1 | 0 | 0 | 0 | 0 | 0 | 3 | 11 | 11 |
| 12 | 0 | 0 | 0 | 1 | 0 | 0 | 0 | 0 | 1 | 0 | 0 | 0 | 0 | 0 | 4 | × | 11,13 |
| 13 | 1 | 0 | 0 | 1 | 0 | 0 | 0 | 0 | 1 | 0 | 0 | 0 | 0 | 0 | 5 | 13 | 13 |
| 14 | 0 | 1 | 0 | 1 | 0 | 0 | 0 | 0 | 1 | 0 | 0 | 0 | 0 | 0 | 6 | × | 13,15 |
| 15 | 1 | 1 | 0 | 1 | 0 | 0 | 0 | 0 | 1 | 0 | 0 | 0 | 0 | 0 | 7 | 15 | 15 |
| 16 | 0 | 0 | 1 | 1 | 0 | 0 | 0 | 0 | 1 | 0 | 0 | 0 | 0 | 0 | 8 | × | 15,17 |
| 17 | 1 | 0 | 1 | 1 | 0 | 0 | 0 | 0 | 1 | 0 | 0 | 0 | 0 | 0 | 9 | 17 | 17 |
| 18 | 0 | 1 | 1 | 1 | 0 | 0 | 0 | 0 | 1 | 0 | 0 | 0 | 0 | 0 | 10 | × | 17,19 |
| 19 | 1 | 1 | 1 | 1 | 0 | 0 | 0 | 0 | 1 | 0 | 0 | 0 | 0 | 0 | 11 | 19 | 19 |
| 20 | 0 | 0 | 0 | 1 | 0 | 0 | 0 | 0 | 0 | 1 | 0 | 0 | 0 | 0 | 4 | × | 19,21 |
| 21 | 1 | 0 | 0 | 1 | 0 | 0 | 0 | 0 | 0 | 1 | 0 | 0 | 0 | 0 | 3 | 21 | 21 |
| 22 | 0 | 1 | 0 | 1 | 0 | 0 | 0 | 0 | 0 | 1 | 0 | 0 | 0 | 0 | 2 | × | 21,23 |
| 23 | 1 | 1 | 0 | 1 | 0 | 0 | 0 | 0 | 0 | 1 | 0 | 0 | 0 | 0 | 1 | 23 | 23 |
| 24 | 0 | 0 | 1 | 1 | 0 | 0 | 0 | 0 | 0 | 1 | 0 | 0 | 0 | 0 | 0 | × | 23,25 |
| 25 | 1 | 0 | 1 | 1 | 0 | 0 | 0 | 0 | 0 | 1 | 0 | 0 | 0 | 0 | 1 | 25 | 25 |
| 26 | 0 | 1 | 1 | 1 | 0 | 0 | 0 | 0 | 0 | 1 | 0 | 0 | 0 | 0 | 2 | × | 25,27 |
| 27 | 1 | 1 | 0 | 1 | 0 | 0 | 0 | 0 | 0 | 1 | 0 | 0 | 0 | 0 | 5 | 27 | 27 |

FIG.7B

| | 1 sub frame(group of subfields) | | | | | | | | 2 sub frame(group of subfields) | | | | | | | | |
|---|---|---|---|---|---|---|---|---|---|---|---|---|---|---|---|---|---|
| Subfield | sf1 | sf2 | sf3 | sf4 | sf5 | sf6 | sf7 | sf8 | sf1' | sf2' | sf3' | sf4' | sf5' | sf6' | Difference of weight sum | Input grayscale selection | Output grayscale candidate |
| Weight / Input grayscale | 1 | 2 | 4 | 8 | 16 | 32 | 68 | 116 | 4 | 12 | 24 | 40 | 68 | 116 | | | |
| 11 | 1 | 1 | 1 | 0 | 0 | 0 | 0 | 0 | 1 | 0 | 0 | 0 | 0 | 0 | 3 | 11 | 11 |
| 12 | 0 | 0 | 0 | 1 | 0 | 0 | 0 | 0 | 1 | 0 | 0 | 0 | 0 | 0 | 4 | × | 11,15 |
| 13 | 1 | 0 | 0 | 1 | 0 | 0 | 0 | 0 | 1 | 0 | 0 | 0 | 0 | 0 | 5 | × | 11,15 |
| 14 | 0 | 1 | 0 | 1 | 0 | 0 | 0 | 0 | 1 | 0 | 0 | 0 | 0 | 0 | 6 | × | 11,15 |
| 15 | 1 | 1 | 0 | 1 | 0 | 0 | 0 | 0 | 1 | 0 | 0 | 0 | 0 | 0 | 7 | 15 | 15 |
| 16 | 0 | 0 | 1 | 1 | 0 | 0 | 0 | 0 | 1 | 0 | 0 | 0 | 0 | 0 | 8 | × | 15,17 |
| 17 | 1 | 0 | 1 | 1 | 0 | 0 | 0 | 0 | 1 | 0 | 0 | 0 | 0 | 0 | 9 | 17 | 17 |
| 18 | 0 | 1 | 1 | 1 | 0 | 0 | 0 | 0 | 1 | 0 | 0 | 0 | 0 | 0 | 10 | × | 17,19 |
| 19 | 1 | 1 | 1 | 1 | 0 | 0 | 0 | 0 | 1 | 0 | 0 | 0 | 0 | 0 | 11 | 19 | 19 |
| 20 | 0 | 0 | 0 | 1 | 0 | 0 | 0 | 0 | 0 | 1 | 0 | 0 | 0 | 0 | 4 | × | 19,23 |
| 21 | 1 | 0 | 0 | 1 | 0 | 0 | 0 | 0 | 0 | 1 | 0 | 0 | 0 | 0 | 3 | × | 19,23 |
| 22 | 0 | 1 | 0 | 1 | 0 | 0 | 0 | 0 | 0 | 1 | 0 | 0 | 0 | 0 | 2 | × | 19,23 |
| 23 | 1 | 1 | 0 | 1 | 0 | 0 | 0 | 0 | 0 | 1 | 0 | 0 | 0 | 0 | 1 | 23 | 23 |
| 24 | 0 | 0 | 1 | 1 | 0 | 0 | 0 | 0 | 0 | 1 | 0 | 0 | 0 | 0 | 0 | × | 23,25 |
| 25 | 1 | 0 | 1 | 1 | 0 | 0 | 0 | 0 | 0 | 1 | 0 | 0 | 0 | 0 | 1 | 25 | 25 |
| 26 | 0 | 1 | 1 | 1 | 0 | 0 | 0 | 0 | 0 | 1 | 0 | 0 | 0 | 0 | 2 | × | 25,27 |
| 27 | 1 | 1 | 0 | 1 | 0 | 0 | 0 | 0 | 0 | 1 | 0 | 0 | 0 | 0 | 5 | 27 | 27 |

PLASMA DISPLAY PANEL AND METHOD FOR PROCESSING PICTURES THEREOF

CROSS-REFERENCE TO RELATED APPLICATION

This application claims priority to and the benefit of Korean Patent Application 10-2005-0002818 filed in the Korean Intellectual Property Office on Jan. 12, 2005, the entire content of which is incorporated herein by reference.

FIELD OF THE INVENTION

The present invention relates to a plasma display device and an image processing method thereof.

BACKGROUND OF THE INVENTION

Recently, flat panel displays, such as liquid crystal displays (LCDs), field emission displays (FEDs) and plasma display panels (PDPs), have been actively developed. PDPs are advantageous over the other flat panel displays in regard to their high luminance, high luminous efficiency and wide viewing angle. Accordingly, PDPs are in the spotlight as a substitute for conventional cathode ray tubes (CRTs) for large-screen displays of more than 40 inches.

PDPs are flat panel displays that use plasma generated by gas discharge to display characters or images. PDPs include, according to their size, more than several hundreds of thousands to millions of pixels arranged in the form of a matrix. These PDPs are classified into a direct current (DC) type and an alternating current (AC) type according to patterns of waveforms of driving voltages applied thereto and discharge cell structures thereof.

A DC PDP has electrodes exposed to a discharge space, thereby causing current to directly flow through the discharge space during application of a voltage to the DC PDP. In this regard, the DC PDP has a disadvantage in that it requires a resistor for limiting the current. On the other hand, an AC PDP has electrodes covered with a dielectric layer that naturally forms a capacitance component to limit the current and protects the electrodes from the impact of ions during discharge. As a result, the AC PDP is superior to the DC PDP in regard to a long lifetime.

A plasma display device such as this divides an input video signal data of one frame into a plurality of subfields, and displays grayscales by time-dividing the subfields, as shown in FIG. 1. In general, the subfields can be expressed by temporal operation periods, i.e., a reset period, an address period and a sustain period. The reset period is a period to initialize the state of each cell such that an addressing operation of each cell is smoothly performed, and the address period is a period to select a cell to be turned on and a cell not to be turned on in the PDP. The sustain period is a period to apply sustain pulses to the addressed cell, thereby performing a discharge according to which a picture is actually displayed.

FIG. 1 illustrates a case where one frame is divided into 8 subfields in order to express 256 grayscale levels. Each subfield SF1-SF8 includes a reset period (not shown), an address period A1-A8 and a sustain period S1-S8. The sustain period S1-S8 has light emitting periods 1 T, 2 T, 4 T, . . . , 128 T at ratios of 1:2:4:8:16:32:64:128.

For example, a grayscale level 3 is expressed by discharging a discharge cell during a subfield having a light emitting period of 1 T and a subfield having a light emitting period of 2 T so as to have a total light emitting period of 3 T In this way, a combination of different subfields having different light emitting periods produces pictures of 256 grayscale levels.

When an input video signal data of one frame is divided into a plurality of subfields and grayscales are displayed according to on/off states of the subfields as described above, a false contour may be generated due to human visual properties. That is, when a moving image is displayed, a false contour phenomenon may occur in which a grayscale, different from an actual grayscale, is perceived by human eyes because of visual properties of the human eyes that follows the movement of the image.

Further, when grayscales are displayed according to turning the subfields on and off, a certain grayscale may have a large gap between subfields that are turned on. For such a grayscale, a low discharge (meaning that a discharge is not effectively generated) may occur.

For example, in the subfield arrangement of FIG. 1, grayscale 4 is expressed when the first and second subfields SF1 and SF2 are off and the third subfield SF3 is on. In this case, at the third subfield SF3, few priming particles may exist since the previous subfields SF1 and SF2 had been off. The third subfield may therefore fail to turn on. When this desired subfield is not turned on, expressing a corresponding grayscale becomes more problematic for low grayscales.

The above information disclosed in this Background section is only for enhancement of understanding of the background of the invention and therefore, it may contain information that does not form the prior art that is already known in this country to a person of ordinary skill in the art.

SUMMARY OF THE INVENTION

Various embodiments of the present invention may provide a plasma display device and an image processing method thereof having advantages of reducing a false contour and avoiding a low discharge of grayscales.

A plasma display device and an image processing method thereof according to an embodiment of the present invention expresses a grayscale by a combination of a plurality of subfields divided from a frame of an input video signal.

One embodiment of the image processing method includes detecting a moving image block and a still image block from input video signals. Output grayscales corresponding to original grayscales of the detected still image block are determined such that respective output grayscales corresponding to the original grayscales of the detected still image block satisfy a first condition that the number of consecutive non-lighting subfields is less than or equal to L among subfields driven previously to a last turn-on subfield of the corresponding grayscales. Output grayscales are further determined corresponding to original grayscales of the detected moving image block such that respective output grayscales corresponding to original grayscales of the detected moving image block satisfy a second condition that the number of consecutive non-lighting subfields is less than or equal to M and a third condition that a total number of non-lighting subfields is less than or equal to N among subfields driven previously to a last turn-on subfield of the corresponding grayscale. The determined output grayscales of the detected still image block and the moving image block are then displayed on the plasma display device.

The numbers L, M and N may be respectively given as 2, 1, and 2.

In a further embodiment, an image processing method of a plasma display device expresses a grayscale by a combination of a turn-on subfield in a first group of subfields and a turn-on subfield in a second group of subfields, the first and second groups of subfields are divided from a plurality of subfields having respective weights, The image processing method of this embodiment includes detecting a moving image block or a still image block from the input video signals, determining output grayscales corresponding to original grayscales of the detected still image block such that respective output grayscales corresponding to the original grayscales of the detected still image block satisfy a first condition that the number of consecutive non-lighting subfields is less than or equal to L among subfields driven previously to a last turn-on subfield of the first and second group of subfields for the corresponding grayscale. The embodiment further includes determining output grayscales corresponding to original grayscales of the detected moving image block such that output grayscales corresponding to original grayscales of the detected moving image block satisfy a second condition that the respective number of consecutive non-lighting subfields is less than or equal to M and a third condition that the total of non-lighting subfields is less than or equal to N among subfields driven previously over the last turn-on subfield of the respective first and second groups of subfields for the corresponding grayscale. The determined output grayscales of the still image block and the moving image block are displayed on the plasma display device.

The numbers L, M and N may be respectively given as 2, 1, and 2.

In a yet further embodiment, a plasma display device includes a plasma display panel including a plurality of first and second electrodes, and a plurality of third electrodes crossing the first and the second electrodes.

The plasma display device includes a controller for controlling output grayscales corresponding to original grayscales by detecting a moving image block and still image block from input video signals. The controller further determines output grayscales corresponding to original grayscales of the detected still image block such that respective output grayscales corresponding to the original grayscales of the detected still image block satisfy a first condition that the number of consecutive non-lighting subfields is less than or equal to L among subfields driven previously to a last turn-on subfield of the corresponding grayscales. The controller further determines output grayscales corresponding to original grayscales of the detected moving image block such that respective output grayscales corresponding to original grayscales of the detected moving image block satisfy a second condition that the number of continuous non-lighting subfields is less than or equal to M and a third condition that a total number of non-lighting subfields is less than or equal to N among subfields driven previously over the last turn-on subfield of the corresponding grayscale. A plasma display panel driver is also included for driving the first electrodes, second electrodes, and third electrodes in response to control signals generated by the controller.

The input video signal may be a NTSC video signal.

In a yet further embodiment, a plasma display device includes a plasma display panel including a plurality of first and second electrodes, and a plurality of third electrodes crossing the first and the second electrodes.

The plasma display device further includes a controller for controlling output grayscales corresponding to original grayscales by dividing a plurality of subfields having respective weight values into a first group of subfields and a second group of subfields, determining output grayscales corresponding to original grayscales of the detected still image block such that respective output grayscales corresponding to the original grayscales of the detected still image block satisfy a first condition that the respective number of consecutive non-lighting subfields is less than or equal to L among subfields driven previously over the last turn-on subfield of the respective first and second group of subfields for the corresponding grayscales. The controller further determines output grayscales corresponding to original grayscales of the detected moving image block such that output grayscales corresponding to original grayscales of the detected moving image block satisfy a second condition that the respective number of continuous non-lighting subfields is less than or equal to M and a third condition that a total number of non-lighting subfields is less than or equal to N among subfields driven previously over the last turn-on subfield of the respective first and second group of subfields for the corresponding grayscale. A plasma display panel driver is further included for driving the first electrodes, second electrodes and the third electrodes in response to control signals generated by the controller.

The input video signal may be PAL video signal.

The controller may determine the output grayscale value such that the first coming subfield at the first group of subfields is turned on, and such that a sum of the weight values of turn-on subfields has a difference between the first group of subfields and the second group of subfields and the difference is less than a predetermined value.

In a yet further embodiment, a plasma display device includes a plasma display panel having a plurality of discharge cells for representing grayscales corresponding to the sum of weight values of the turn on subfields at a plurality of subfield having respective weight values. A controller is also included for detecting a moving image block and a still image block from input video signals. In case of inputting NTSC video signals, the controller controls the plurality of subfields driven successively and controls output grayscales corresponding to original grayscales by determining output grayscales corresponding to original grayscales of the detected still image block such that respective output grayscales corresponding to the original grayscales of the detected still image block satisfy a first condition that the number of consecutive non-lighting subfields is less than or equal to L among subfields driven previously to a last turn-on subfield of the corresponding grayscales. The controller further determines output grayscales corresponding to original grayscales of the detected moving image block such that respective output grayscales corresponding to original grayscales of the detected moving image block satisfy a second condition that the number of continuous non-lighting subfields is less than or equal to M and a third condition that a total number of non-lighting subfields is less than or equal to N among subfields driven previously to a last turn-on subfield of the corresponding grayscale. In the case of inputting a PAL video signal, the controller controls output grayscales corresponding to original grayscales by dividing a plurality of subfields having respective weight values into a first and a second group of subfields, determining output grayscales corresponding to original grayscales of the detected still image block such that output grayscales corresponding to the original grayscales of the detected still image block satisfy a first condition that the respective number of consecutive non-lighting subfields is less than or equal to I among subfields driven previously to a last turn-on subfield of the respective first and second groups of subfields for the corresponding grayscales. The controller further determines output grayscales corresponding to original grayscales of the detected moving image block such that output grayscales corresponding to original grayscales of the detected moving image block satisfy a second condition that the respective number of continuous non-lighting subfields is less than or equal to J and a third condition that a total number of non-lighting subfields is less than or equal to K among subfields driven previously to a last turn-on subfield of the respective first and second groups of subfields for the corresponding grayscale. A plasma display panel driver is further included for driving the first electrodes, second electrodes, and third electrodes in response to control signals generated by the controller.

BRIEF DESCRIPTION OF THE DRAWINGS

FIG. 4A illustrates a part of an exemplary table used for grayscale conversion, when an input video signal is a still image.

FIG. 4B illustrates a part of an exemplary table used for grayscale conversion, when an input video signal is a moving image.

FIG. 5A illustrates an example of a 2×2 dithering matrix.

FIG. 5B illustrates an example of an 8×8 dithering matrix.

FIG. 7A illustrates a part of an exemplary table used for grayscale conversion, when an input video signal is a still image in a PAL format.

FIG. 7B illustrates a part of an exemplary table used for grayscale conversion, when an input video signal is a moving image in a PAL format.

DETAILED DESCRIPTION OF THE EMBODIMENTS

Figure 1:
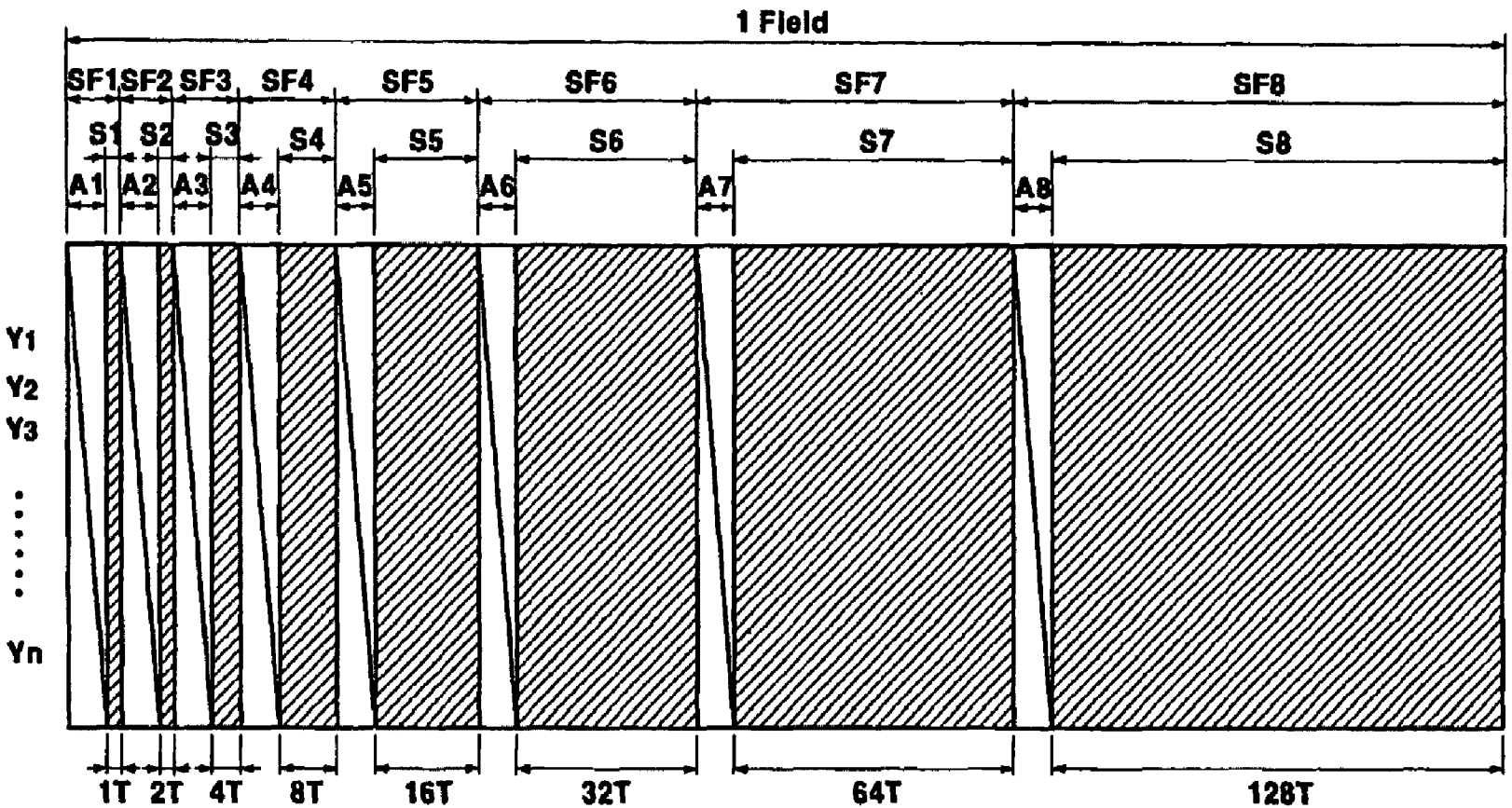
FIG. 1 is a diagram illustrating a method for expressing a grayscale of a plasma display panel.

In the following detailed description, only certain exemplary embodiments of the present invention are shown and described, simply by way of illustration. As those skilled in the art would realize, the described embodiments may be modified in various different ways, all without departing from the spirit or scope of the present invention.

Accordingly, the drawings and description are to be regarded as illustrative in nature and not restrictive. Like reference numerals designate like elements throughout the specification.

A plasma display device and an image processing method thereof according to an exemplary embodiment of the present invention will hereinafter be described in detail with reference to the accompanying drawings.

Figure 2:
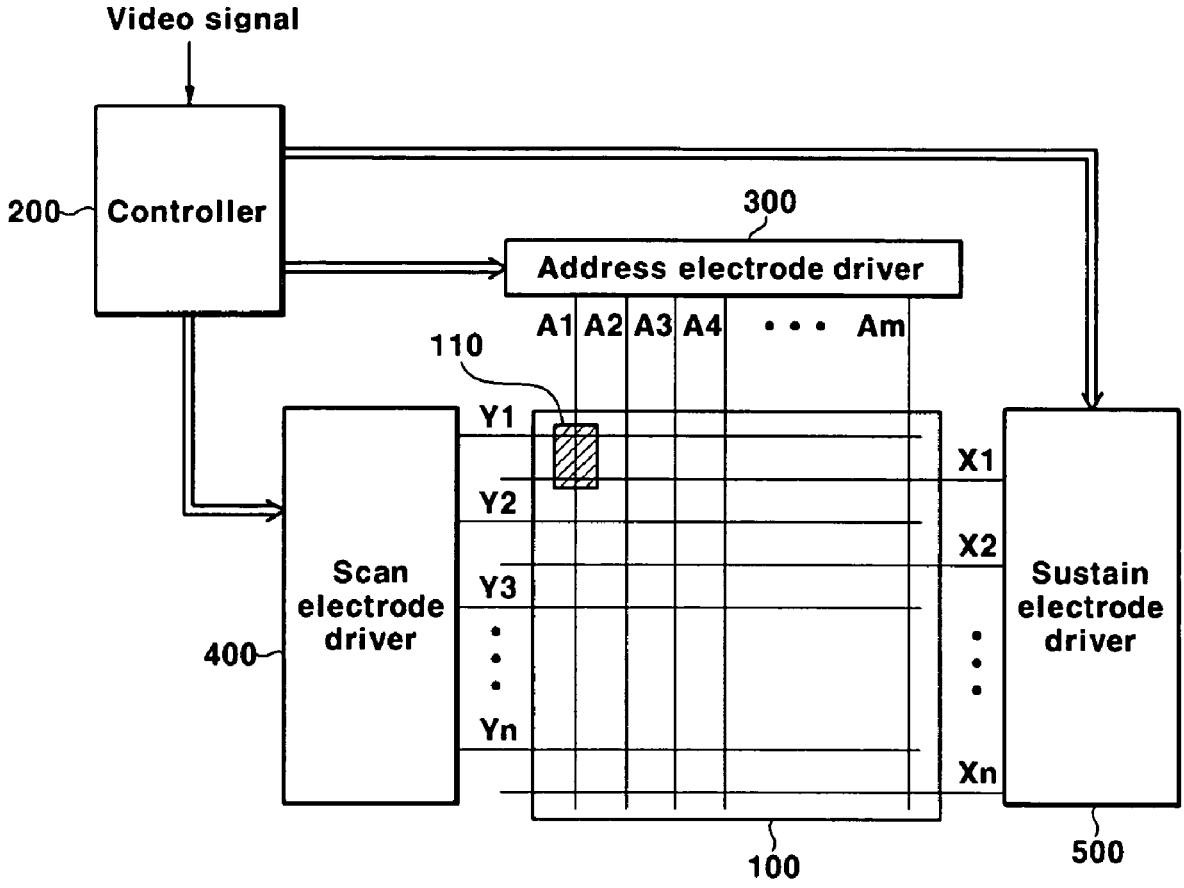
FIG. 2 is a schematic plan view of a PDP according to an exemplary embodiment of the present invention.

As shown in FIG. 2, a plasma display device includes a PDP 100, a controller 200, an address driver 300, a scan electrode driver (hereinafter called a Y electrode driver) 400, and a sustain electrode driver (hereinafter called an X electrode driver) 500.

The PDP 100 includes a plurality of address electrodes A1 to Am arranged as columns, and a plurality of scan electrodes Y1 to Yn and a plurality of sustain electrodes X1 to Xn alternately arranged as rows. The X electrodes X1 to Xn are respectively formed corresponding to the Y electrodes Y1 to Yn. The PDP includes a substrate (not shown) formed with the sustain and scan electrodes X1-Xn and Y1-Yn and another substrate (not shown) formed with the address electrodes A1-Am. The two substrates are facing each other such that the sustain and scan electrodes X1-Xn and Y1-Yn may perpendicularly cross the address electrodes A1-Am. Discharge cells are formed by discharge spaces formed at crossing regions where the address electrodes meet the scan and sustain electrodes. It is should be understood that such a structure of the PDP 100 is only an example, and the present invention is not limited thereto, since the spirit of the present invention may be applied to various other structures of a PDP.

The address driver 300 receives address driving control signals from the controller 200, and applies display data signals for selecting desired discharge cells to the respective address electrodes A1 to Am. The X electrode driver 400 receives X electrode driving control signals from the controller 200, and applies driving voltages to the X electrodes X1 to Xn. The Y electrode driver 500 receives Y electrode driving control signals from the controller 200, and applies driving voltages to the Y electrodes Y1 to Yn.

The controller 200 externally receives video signals, and outputs the address driving control signals, the X electrode driving control signals, and the Y electrode driving control signals. Also, the controller 200 drives the panel 100 by a plurality of subfields divided from a frame, wherein each subfield includes a reset period, an address period, and a sustain period in a temporal order. According to an exemplary embodiment of the present invention, the controller 200 converts grayscales of input video signals (i.e., R, G, B data) before outputting them, in order to solve low discharge and false contour problems. Also, the controller 200 applies a dithering algorithm for the converted grayscales so as to compensate the original grayscales.

A controller of a plasma display device according to an exemplary embodiment of the present invention will hereinafter be described in detail with reference to FIG. 3, FIG. 4A, and FIG. 4B. In this embodiment, the controller is designed to solve a low discharge problem and a false contour problem at a subfield arrangement applied to an NTSC format.

Figure 3:
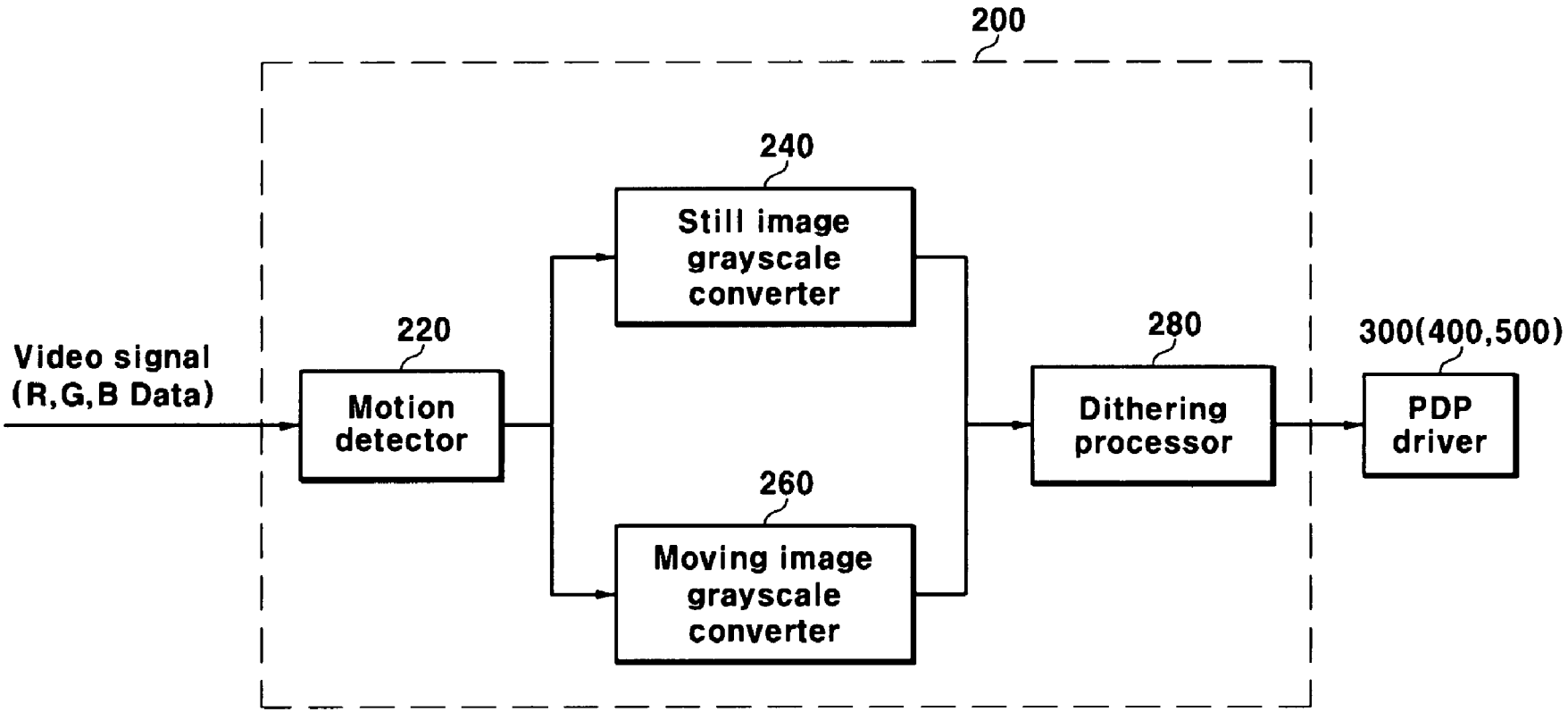
FIG. 3 is a schematic block diagram of a controller according to the embodiment of FIG. 2.

As shown in FIG. 3, the controller 200 of a plasma display device includes a motion detector 220, a still image grayscale converter 240, a moving image grayscale converter 260, and a dithering processor 280.

The motion detector 220 divides whole pixels used for displaying one frame of a video signal into predetermined blocks, that is moving image blocks that display a moving image and still image blocks that do not. Because most of false contours are generated at moving images, the grayscale conversion for reducing a false contour may be performed at the moving image blocks, while the grayscale conversion for improving a low discharge at low grayscales is performed at the still image blocks. Whether a respective block displays a moving image can be determined by a sum of the difference of grayscales between the previous frame and current frame for respective pixels. The following equation 1 shows a method for calculating such a difference in grayscales.

Equation 1

$$\text{diff_criterion}(x,y)=|i_n(x,y)-i_{n-1}(x,y)|$$

In Equation 1, $i_n(x,y)$ designates a grayscale at the (x,y) position of the present frame image data, and $i_{n-1}(x,y)$ designates a grayscale at the (x,y) position of the previous frame. In this case, the "block-wise" difference of grayscales is acquired by adding up the difference of grayscales calculated in the equation 1 for respective pixels in a block. When the block-wise difference of grayscales is greater than or equal to a predetermined value, the corresponding block is determined as a moving image block. When the block-wise difference of grayscales is less than the predetermined value, the corresponding block is determined as a still image block. The predetermined value may be obtained to be an appropriate value based on empirical data. The method for obtaining an appropriate value of the predetermined value will be readily understood to a person of ordinary skill in the art, and is not described in further detail.

The motion detector 220 includes a frame memory (not shown) for storing data from a previous frame, and is used to detect moving image signals through methods such as Equation 1. The blocks divided from the whole pixels for representing data of the one frame may be preset to a predetermined size, for example, to a size corresponding to one pixel or a whole screen.

In this manner, the motion detector 220 detects whether blocks display moving images or still images, and sends the detected information to the still image grayscale converter 240 and the moving image grayscale converter 260.

In order to improve a low discharge at low grayscales of still image blocks, one embodiment of the still image grayscale converter 240 converts still image grayscales using the table shown in FIG. 4A and outputs the converted grayscales. As shown in FIG. 4A, the image grayscale converter 240 outputs, for grayscales (e.g., grayscales 2, 4, 6 . . . ) that may suffer from a low discharge, output grayscale candidates. The output grayscale candidates are adjacent grayscales. These adjacent grayscales are output to avoid a low discharge at a low grayscale. For example, grayscale 1 and 3 are output instead of grayscale 2, grayscale 3 and 5 instead of grayscale 4, etc. For grayscales which are not expected to suffer from a low grayscale (e.g., grayscales 1, 3, 5 . . . ), the grayscale converter 240 directly outputs input grayscales. A method for acquiring such a table as FIG. 4A will be hereinafter described in detail.

FIG. 4A is a predetermined table satisfying conditions for improving a low discharge at low grayscales in the case where weights of respective subfields are arranged as followed: {1(sf1), 2(sf2), 4(sf3), 8(sf4), 16(sf5), 32(sf6), 42(sf7), 44(sf8), 52(sf9), 54(sf10)}. The low discharge at low grayscales is generated at predetermined subfields in which light is not emitted because sufficient priming particles are not present.

Accordingly, the predetermined grayscales satisfying the following conditions are used: a condition (hereinafter, referred to as 'condition 1') that a first-coming subfield sf1 is a turn-on subfield; and a condition (hereinafter, referred to as 'condition 2') that the number of the consecutive non-lighting subfields is less than or equal to L (in this case L=2). A "non-lighting subfield" is defined as a turn-off subfield driven previously to the last turn-on subfield to express the corresponding grayscale among a group of successively driving subfields (i.e., among the whole subfield in the case of NTSC video signal input, and among a later described group of sub-frames in the case of PAL video signal input). When at least one of condition 1 and condition 2 is not satisfied, adjacent higher and lower grayscales satisfying both condition 1 and condition 2 are selected as output grayscale candidates. When the first-coming subfield sf1 (hereinafter simply called a first subfield) is turned on, reset and sustain discharges caused thereby generate a large amount of priming particles. Thus, the priming particles may remain even when a non-lighting subfield follows. FIG. 4A is a predetermined table satisfying these conditions 1 and 2.

For example, when an input grayscale is a grayscale 2, the first subfield sf1 is not turned on and the condition 1 is not satisfied. Accordingly, grayscale 1 and grayscale 3 satisfying the conditions 1 and 2 are selected as output grayscale candidates, wherein the grayscale 1 and grayscale 3 are adjacent lower and higher grayscales of the grayscale 2. Also, when an input grayscale is a grayscale 8, the first subfield sf1 through the third subfield sf3 are not turned on and the condition 2 is not satisfied. Accordingly, grayscale 7 and grayscale 9 satisfying the conditions 1 and 2 are selected as the output grayscale candidates, wherein the grayscale 7 and grayscale 9 are the adjacent lower and higher grayscales of the grayscale 8. When an input grayscale is a grayscale 3, both of the conditions 1 and 2 are satisfied. Accordingly, a grayscale 3 is adopted as an output grayscale candidate.

The subfield weight arrangement {1(sf1), 2(sf2), 4(sf3), 8(sf4), 16(sf5), 32(sf6), 42(sf7), 44(sf8), 52(sf9), 54(sf10)} shown in FIG. 4A is one example. If both of the conditions 1 and 2 are satisfied, the arrangement can be obviously varied by a person skilled in the art.

In order to improve a false contour problem of moving image blocks, one embodiment of the moving image grayscale converter 260 converts the grayscales of the corresponding blocks using such a table as shown in FIG. 4B, and outputs the converted grayscales. As shown in FIG. 4B, the moving image grayscale converter 260 outputs, for predetermined grayscale values (i.e., grayscale 2, 4, 6 . . . ) that may suffer from a false contour, output grayscale candidate values. Output grayscale candidates are adjacent grayscales to avoid a false contour, i.e., grayscale 1 and 3 instead of grayscale 2, grayscale 3 and 5 instead of grayscale 4. For predetermined grayscale values (i.e., grayscale 1, 3, 5 . . . ) that are not expected to suffer from a false contour, the grayscale converter 240 directly outputs input grayscales. A method for acquiring such a table as FIG. 4B will hereinafter be described in detail.

FIG. 4B is a predetermined table satisfying conditions for improving false contour in the case that weights of respective subfields are as follows: {1 (sf1), 2(sf2), 4(sf3), 8(sf4), 16(sf5), 32(sf6), 42(sf7), 44(sf8), 52(sf9), 54(sf10)}. A false contour is generated at moving images and dissimilar subfield lighting patterns. Accordingly, to avoid the false contour, the subfield lighting pattern should be set to be similar between adjacent grayscales. Accordingly, the predetermined grayscales satisfying the following conditions are used: a condition (hereinafter, referred to as 'condition 3') that a first-coming subfield sf1 is a turn-on subfield, a condition (hereinafter, referred to as 'condition 4') that the number of consecutive non-lighting subfields is less than or equal to M (in this case M=1); condition (hereinafter, referred to as 'condition 5') that the total number of the non-lighting subfields is less than or equal to N (in this case N=2). When at least one of condition 3 through condition 5 is not satisfied, adjacent higher and lower grayscales, satisfying condition 3 through condition 5 are selected as output grayscale candidates. FIG. 4B is a predetermined table satisfying these conditions 3 through 5.

For example, when an input grayscale is a grayscale 2, the first subfield sf1 is not turned on and the condition 3 is not satisfied. Accordingly, grayscale 1 and grayscale 3 satisfying the conditions 3 through 5 are selected as output grayscale candidates, wherein the grayscale 1 and grayscale 3 are respectively adjacent higher and lower grayscales of the grayscale 2. When an input grayscale is a grayscale 4, the conditions 3 and 4 are not satisfied. Accordingly, adjacent higher and lower grayscales 3 and 5 are selected as output grayscale candidates. When an input grayscale is a grayscale 9, second subfield sf2 and third subfield sf3 are not turned on so that there are consecutive two non-lighting subfields; as a result, the condition 4 is not satisfied. Accordingly, adjacent higher and lower grayscales 7 and 11 are selected as output grayscale candidates, The subfield weight arrangement {1(sf1), 2(sf2), 4(sf3), 8(sf4), 16(sf5), 32(sf6), 42(sf7), 44(sf8), 52(sf9), 54(sf10)} shown in FIG. 4B is one example. If the conditions 3 through 5 are satisfied, the arrangement can be varied as desired by a person skilled in the art.

The data processed in this manner by the still image grayscale converter 240 and the moving image grayscale converter 260 are sent to the dithering processor 280.

When two output grayscale candidates are produced according to the table shown in FIG. 4A or FIG. 4B, the two grayscale candidates have grayscale differences from an actual input grayscale. The grayscale differences may be used to display the desired input grayscale in an averaged manner by spatially mixing the two determined output grayscale candidates in a predetermined ratio. Operation of the dithering processor 280 for expressing the input grayscale in such an averaged manner will be described hereafter.

For the grayscales having the two output grayscale candidates for one input grayscale, the dithering processor 280 applies a dithering process in order to compensate the grayscale difference. In other words, the dithering processor 280 is used to select an appropriate candidate from among the determined output candidates and represent a grayscale close to the desired grayscale within a predetermined area.

When the output grayscale candidates are 3 and 5 corresponding to the input grayscale 4, for example, the two grayscales 3 and 5 in a 2×2 display area are respectively determined to be output, the mean value in the 2×2 area becomes 4 and it is hence possible to represent the input grayscale 4. In this instance, an output value of each pixel in the 2×2 area is determined from among the output grayscale candidates according to a threshold value of the pixel. That is, when the grayscale 4 is smaller than a pixel's threshold value, the grayscale 3 is output and when the grayscale 4 is larger than a pixel's threshold value, the grayscale 5 is output. The following equation 2 shows a method for expressing such dithering calculation.

Equation 2

```
IF(i(x,y)<Threshold(x,y))
{
result(x,y)=level_min;
}
ELSE
{
result(x,y)=level_max;
}
```

In Equation 2, i(x,y) is a current grayscale, Threshold(x,y) is a threshold value, and result(x,y) is a grayscale finally output by the plasma display device, and, $level_{min}$ and $level_{max}$ respectively represent a lower grayscale and a higher grayscale from among the found output candidates. The lower grayscale $level_{min}$ is output as output grayscale result (x,y) when the current input grayscale i(x,y) is smaller than threshold(x,y), and the higher grayscale $level_{max}$ is output as output grayscale result(x,y) when the current input grayscale i(x,y) is larger than threshold(x,y).

In this case, a threshold(x,y) value of each pixel is determined depending on the given dithering matrix and two output candidates. FIG. 5A shows an example of a 2×2 dithering matrix and FIG. 5B shows an example of 8×8 dithering matrix. For example, in the case of considering a 2×2 area, the value between the two output candidates is divided with gaps of the same size and the gaps are filled with threshold values in the four positions of the 2×2 area. The process for determining the threshold values may be expressed as the following Equation 3.

Equation 3

$$\text{Threshold}(x, y) = level_{\min} + \frac{level_{\max} - level_{\min}}{\text{Dither_Size} + 1} \times \text{Dither}[y\%\text{D_h}][x\%\text{D_w}]$$

In Equation 3, Dither_Size represents a maximum size of the dithering matrix, and Dither_Size has a value of 4 in such a dithering matrix as shown in FIG. 5A and a value of 64 in such a dithering matrix as shown in FIG. 5B. Dither□□ is a dithering matrix which is used for determining arrangement positions of the determined threshold values. D_w and D_h are dimensions of a width and a height of the dithering matrix respectively, and % is an operator for calculating a remainder and is used to apply a predetermined dimension of the dithering matrix to the whole image corresponding to one frame without superposition. Therefore, the threshold values of the respective pixels are calculated throughout the whole frame of image according to Equation 3.

According to one embodiment of the present invention, the controller 200 generates a final grayscale signal using the dithering processor 280, and sends it to the PDP drivers that is the address driver 300 and the scan and sustain drivers 400 and 500.

A controller of plasma display device according to another embodiment of the present invention will hereinafter be described in detail with reference to FIG. 6, FIG. 7A, and FIG. 7B. In this embodiment, the controller is designed to solve a low discharge problem and a false contour problem at a subfield arrangement applied to a PAL format. The PAL format divides subfield weight values used at one frame in two subframes (a group of subfields) to reduce flicker.

Figure 6:
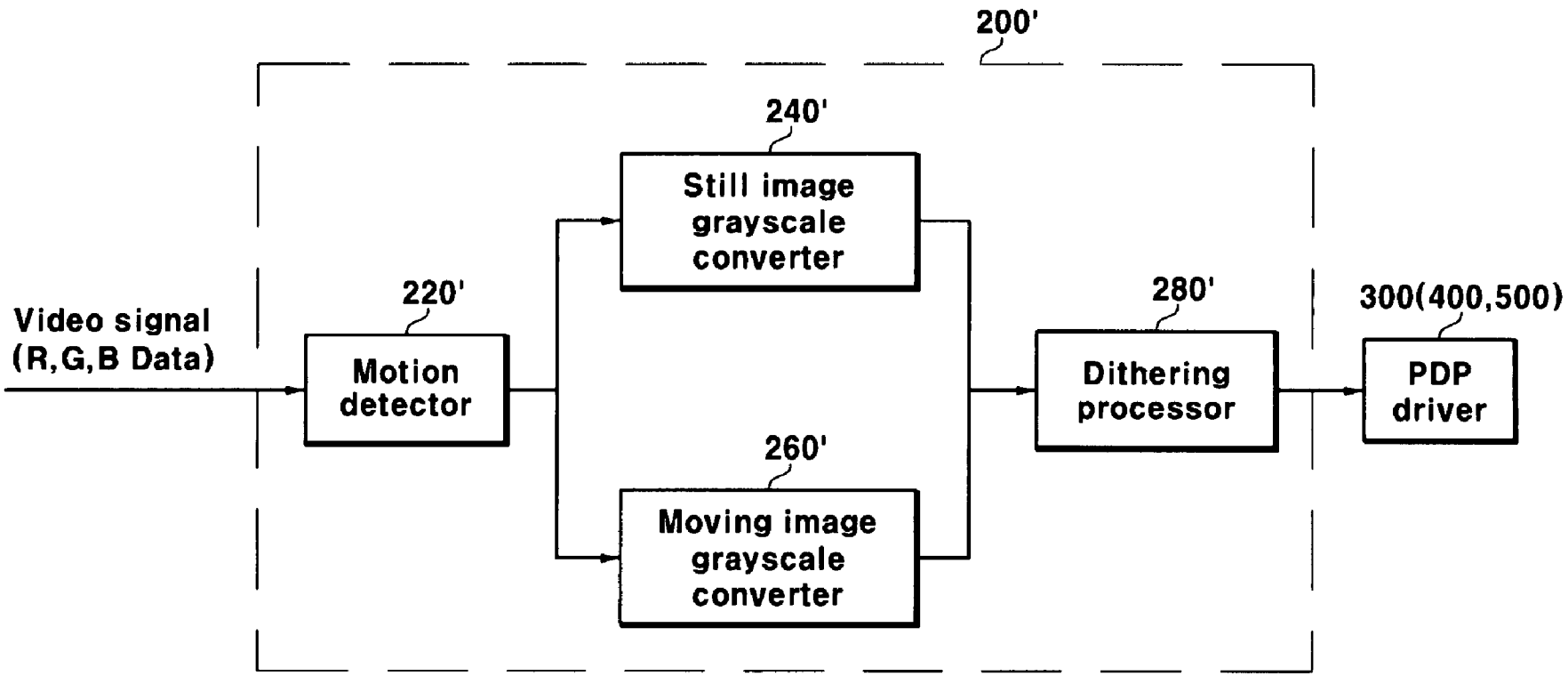
FIG. 6 is a schematic block diagram of a controller according to another exemplary embodiment of the present invention.

As shown in FIG. 6, a controller 200' includes a motion detector 220', a still image grayscale converter 240', a moving image grayscale converter 260' and a dithering processor 280'. The still image grayscale converter 240' and the moving image grayscale converter 260' are operated according to different grayscale conversion conditions than the previously described embodiments. The motion detector 220' and dithering processor 280' are operated as described above.

The input grayscale is reset to satisfy a condition (hereinafter, referred to as 'condition 6') to turn on the first subfield sf1 and a condition (hereinafter, referred to as 'condition 7') that the number of the adjacent non-lighting subfields is less than or equal to I (in this case I=2) for the respective subframes. When both of condition 6 and condition 7 are satisfied, the input grayscale is directly output by the still image grayscale converter 240', and when at least one of condition 6 and condition 7 are not satisfied, adjacent higher and lower grayscales, satisfying both of condition 6 and condition 7 are output. As above noted, because subfield weight values used at one frame are divided in two sub-frames in the PAL format, for the respective sub-frames, the condition 7 is requested, i.e., the number of the adjacent non-lighting subfields is less than 2. In the PAL format, in order to reduce flicker occurring when a sum of weights of the light emitting subfields is much different between the two sub-frames, a condition (hereinafter, referred to as 'condition 8') that the difference of these sums is less than the predetermined value (i.e., 20) may be added. For example, as shown in FIG. 7A, when an input grayscale is a grayscale 11, at the 1 sub-frame, the sum of the weight values of turn-on subfields is given as 7. At the 2 sub-frame, the sum of the weight values of turn-on subfields is given as 4 so that the difference of these sums is given as 3.

The predetermined values can be acquired experimentally and the value 20 can be varied as desired by a person skilled in the art.

FIG. 7A is a predetermined table satisfying conditions 6 and 7 for improving a low discharge at low grayscales in the case where weights of respective subfields are arranged as follows: 1 sub-frame={1(sf1), 2(sf2), 4(sf3), 8(sf4), 16(sf5), 32(sf6), 68(sf7), 116(sf8)}, 2 sub-frame={4(sf1'), 12(sf2'), 24(sf3'), 40(sf4'), 68(sf5'), 116(sf6')}. Referring to FIG. 7A, when an input grayscale is given as 12, a first subfield sf1 is turned off in the 1 sub-frame and three non-lighting subfields are arranged consecutively. Therefore the grayscale 12 does not satisfy conditions 6 and 7. Accordingly, adjacent higher and lower grayscales 11 and 13 satisfying the conditions 6 through 8 are selected as output grayscale candidates.

The subfield weight arrangement shown in FIG. 7A is one example. If the conditions 6 and 7 are satisfied, the arrangement can be varied as desired by a person skilled in the art.

Next, in order to reduce a false contour of a moving image block, the moving image grayscale converter 260' converts the output grayscales to satisfy several conditions. An input grayscale is reset to satisfy the following conditions: a condition (hereinafter, referred to as 'condition 9') to turn on a first subfield sf1, a condition (hereinafter, referred to as 'condition 10') that the number of the consecutive non-lighting subfields is less than or equal to J (in this case J=1) for the respective sub-frames and a condition (hereinafter, referred to as 'condition 11') that the total number of the non-lighting subfields is less than or equal to K (in this case K=2) for the respective sub-frame. For example, when all of the conditions 9 through 11 are satisfied, the input grayscale is directly output. When at least one of conditions 9 through 11 is not satisfied, adjacent higher and lower grayscales, satisfying condition 9 through condition 11, are output. Because the PAL format divides subfield weights used at one frame into two sub-frames, the number of the non-lighting subfields or the like are determined for the respective sub-frames as conditions 10 and 11. In order to reduce flicker occurring when the sum of weight values of the light emitting subfields is much different between the two sub-frames, a condition (hereinafter, referred to as 'condition 12') that the difference of these sums is less than the predetermined value (i.e., 20) may be added. The predetermined values may be obtained to be an appropriate value based on empirical data and the value 20 can be varied as desired by a person skilled in the art.

FIG. 7B is a predetermined table satisfying conditions 9 through 11 for reducing a false contour in the case that weights of respective subfields are arranged as followed: 1 sub-frame={1(sf1), 2(sf2), 4(sf3), 8(sf4), 16(sf5), 32(sf6), 68(sf7), 116(sf8)}, 2 sub-frame={4(sf1'), 12(sf2'), 24(sf3'), 40(sf4'), 68(sf5'), 116(sf6')}. Referring to FIG. 7B, when an input grayscale is given as 12, the first subfield (sf1) is turned off at the 1 sub-frame; three non-lighting subfields are arranged consecutively, and the grayscale 12 does not satisfy conditions 9 through 11. Accordingly adjacent lower and higher grayscales 11 and 13 satisfying the conditions 9 through 11 are selected as output grayscale candidates.

The subfield weight arrangement shown in FIG. 7B is one example. If the conditions 9 to 11 are satisfied, the arrangement can be varied as desired by a person skilled in the art.

The data processed in this manner by the still image grayscale converter 240' and the moving image grayscale converter 260' are sent to the dithering processor 280' and are applied to the dithering algorithm in the same manner as described above.

When the common conditions 1, 3, 6 and 9, relating to the first subfield sf1 being turned on, are not used to improve a low discharge of grayscales and a false contour, these conditions may be omitted. The number of consecutive non-lighting subfields and the total number of the non-lighting subfields noted in conditions 2, 4, 5, 7, 8, 10, 11 and 12 are examples of conditions, and these numbers or the like can be varied experimentally as desired to improve a low discharge problem of grayscales and a false contour problem by a person skilled in the art.

While this invention has been described in connection with various embodiments, it is to be understood that the invention is not limited to the disclosed embodiments, but, on the contrary, is intended to cover various modifications and equivalent arrangements included within the spirit and scope of the appended claims and their equivalents.

As above described, the input video signal is determined to be a moving image or a still image. When a still image is detected, the detected still image is converted into grayscales for avoiding a low discharge of grayscale. When a moving image is detected, the moving image is converted into grayscales for reducing a false contour, thereby reducing both false contour and avoiding low scale discharge.

What is claimed is:

1. An image processing method of a plasma display device for expressing a gray level by a combination of a plurality of subfields divided from a frame of an input video signal, the image processing method comprising:

detecting a moving image block and a still image block from the input video signal;

determining output gray levels corresponding to original gray levels of the detected still image block such that respective output gray levels corresponding to the original gray levels of the detected still image block satisfy a first condition that the number of consecutive non-lighting subfields is less than or equal to L among subfields driven previously to a last turn-on subfield of the corresponding output gray levels;

determining output gray levels corresponding to original gray levels of the detected moving image block such that respective output gray levels corresponding to original gray levels of the detected moving image block satisfy a second condition that a number of consecutive non-lighting subfields is less than or equal to M, and a third condition that a total number of non-lighting subfields is less than or equal to N among subfields driven previously to a last turn-on subfield of the corresponding output gray levels; and displaying the determined output gray levels of the detected still image block and moving image on the plasma display device;

wherein when at least one of the original gray levels of the still image block does not satisfy the first condition, the output gray level corresponding to the at least one of the original gray levels of the still image block is determined by selecting at least two output gray level candidates satisfying the first condition and by applying a dithering algorithm to the selected output gray level candidates, and wherein when at least one of the original gray levels of the moving image block does not satisfy at least one of the second condition and the third condition, the output gray level corresponding to the at least one of the original gray levels of the moving image block is determined by selecting at least two output gray level candidates satisfying both of the second and third conditions and by applying a dithering algorithm to the selected output gray level candidates.

2. The image processing method of claim 1, wherein the numbers L, M and N are 2, 1, and 2, respectively.

3. The image processing method of claim 1, wherein the output gray levels of the detected still image block and the moving image block are determined such that a first-coming subfield is turned on.

4. The image processing method of claim 1, wherein:

original gray levels of the still image block that satisfy the first condition are used as output gray levels corresponding thereto; and original gray levels of the moving image block that satisfy the second condition and the third condition are used as output gray levels corresponding thereto.

5. The image processing method of claim 1, wherein the still image block and the moving image block are detected using a sum of gray level differences between a previous frame and a current frame for respective pixels of the input video signal.

6. An image processing method of a plasma display device for expressing a gray level by a combination of a turn-on subfield in a first group of subfields and a turn-on subfield in a second group of subfields, the first and second groups of subfields being divided from a plurality of subfields having respective weights, the image processing method comprising:

detecting a moving image block and a still image block from input video signals;

determining output gray levels corresponding to original gray levels of the detected still image block such that output gray levels corresponding to the original gray levels of the detected still image block satisfy a first condition that the respective number of consecutive non-lighting subfields is less than or equal to L among subfields driven previously to a last turn-on subfield of the respective first and second groups of subfields for the corresponding output gray levels;

determining output gray levels corresponding to original gray levels of the detected moving image block such that output gray levels corresponding to original gray levels of the detected moving image block satisfy a second condition that the respective number of consecutive non-lighting subfields is less than or equal to M and a third condition that the total of non-lighting subfields is less than or equal to N among subfields driven previously to a last turn-on subfield of the respective first and second groups of subfields for the corresponding output gray levels; and displaying the determined output gray levels of the still image block and the moving image block on the plasma display device;

wherein when at least one of the original gray levels of the still image block does not satisfy the first condition, an output gray level corresponding to the at least one of the original gray levels of the still image block is determined by selecting at least two output gray level candidates satisfying the first condition and by applying a dithering algorithm to the selected output gray level candidates, and wherein when at least one of the original gray levels of the moving image block does not satisfy at least one of the second condition and the third condition, an output gray level corresponding to the at least one of the original gray levels of the moving image block is determined by selecting at least two output gray level candidates satisfying both of the second and third conditions and by applying a dithering algorithm to the selected output gray level candidates.

7. The image processing method of a plasma display device of claim 6, wherein the numbers L, M and N are 2, 1, and 2, respectively.

8. The image processing method of a plasma display device of claim 6, wherein the output gray levels of the detected still image block and the moving image block are determined such that a first-coming subfield is turned on at the first group of subfields, and such that a sum of the weight values of turn-on subfields has a difference between the first group of subfields and the second group of subfields and the difference is less than a predetermined value.

9. A plasma display device comprising:

a plasma display panel (PDP) including a plurality of first and second electrodes, and a plurality of third electrodes crossing the first and second electrodes;

a controller for controlling output of gray levels by detecting a moving image block and a still image block from input video signals, determining output gray levels corresponding to original gray levels of the detected still image block such that respective output gray-levels corresponding to the original gray levels of the detected still image block satisfy a first condition that the number of consecutive non-lighting subfields is less than or equal to L among subfields driven previously to a last turn-on subfield of the corresponding output gray levels, and determining output gray levels corresponding to original gray levels of the detected moving image block such that respective output gray levels corresponding to original gray levels of the detected moving image block satisfy a second condition that the number of continuous non-lighting subfields is less than or equal to M and a third condition that a total number of non-lighting subfields is less than or equal to N among subfields driven previously to a last turn-on subfield of the corresponding output gray levels; and a plasma display panel driver for driving the first electrodes, the second electrodes, and the third electrodes in response to control signals generated by the controller;

wherein the controller is configured, such that:

when at least one of the original gray levels of the still image block does not satisfy the first condition, the output gray level corresponding to the at least one of the original gray levels of the still image block is determined by selecting at least two output gray level candidates satisfying the first condition and by applying a dithering algorithm to the selected output gray level candidates, and when at least one of the original gray levels of the moving image block does not satisfy at least one of the second condition and the third condition, the output gray level corresponding to the at least one of the original gray levels of the moving image block is determined by selecting at least two output gray level candidates satisfying both of the second and third conditions and by applying a dithering algorithm to the selected output gray level candidates.

10. The plasma display device of claim 9, wherein the input video signal is an NTSC video signal.

11. The plasma display device of claim 9, wherein the numbers L, M and N are 2, 1, and 2, respectively.

12. The plasma display device of claim 9, wherein the controller determines the output gray levels of the detected still image block and the moving image block such that a first-coming subfield is turned on.

13. A plasma display device comprising:

a plasma display panel including a plurality of first and second electrodes, and a plurality of third electrodes crossing the first and second electrodes;

a controller for controlling output of gray levels by dividing a plurality of subfields having respective weight values into a first group of subfields and a second group of subfields, detecting a moving image block and a still image block from input video signals, determining output gray levels corresponding to original gray levels of the detected still image block such that output gray levels corresponding to the original gray levels of the detected still image block satisfy a first condition that the respective number of consecutive non-lighting subfields is less than or equal to L among subfields driven previously to a last turn-on subfield of the respective first group of subfields and second group of subfields for the corresponding output gray levels, and determining output gray levels corresponding to original gray levels of the detected moving image block such that output gray levels corresponding to original gray levels of the detected moving image block satisfy a second condition that the respective number of continuous non-lighting subfields is less than or equal to M and a third condition that a total number of non-lighting subfields is less than or equal to N among subfields driven previously to a last turn-on subfield of the respective first and second groups of subfields for the corresponding output gray levels; and a plasma display panel driver for driving the first electrodes, the second electrodes, and the third electrodes in response to control signals generated by the controller;

wherein the controller is configured, such that:

when at least one of the original gray levels of the still image block does not satisfy the first condition, the output gray level corresponding to the at least one of the original gray levels of the still image block is determined by selecting at least two output gray level candidates satisfying the first condition and by applying a dithering algorithm to the selected output gray level candidates, and when at least one of the original gray levels of the moving image block does not satisfy at least one of the second condition and the third condition, the output gray level corresponding to the at least one of the original gray levels of the moving image block is determined by selecting at least two output gray level candidates satisfying both of the second and third conditions and by applying a dithering algorithm to the selected output gray level candidates.

14. The plasma display device of claim 13, wherein the input video signal is a PAL video signal.

15. The plasma display device of claim 13, wherein the numbers L, M and N are 2, 1, and 2, respectively.

16. The plasma display device of claim 13, wherein the controller determines the output gray level value such that a first-coming subfield at the first group of subfields is turn on, and such that a sum of the weight values of turn-on subfields has a difference between the first group of subfields and the second group of subfields and the difference is less than a predetermined value.

* * * * *